US012768144B2

(12) United States Patent
Ueta

(10) Patent No.: US 12,768,144 B2
(45) Date of Patent: Oct. 20, 2026

(54) WORK MACHINE FOR CONTROLLING STARTING AND STOPPING OF DRIVE SOURCE

(71) Applicant: KOBELCO CONSTRUCTION MACHINERY CO., LTD., Hiroshima (JP)

(72) Inventor: Toshiro Ueta, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 39 days.

(21) Appl. No.: 18/704,753

(22) PCT Filed: Oct. 14, 2022

(86) PCT No.: PCT/JP2022/038398
§ 371 (c)(1),
(2) Date: Apr. 25, 2024

(87) PCT Pub. No.: WO2023/084992
PCT Pub. Date: May 19, 2023

(65) Prior Publication Data

US 2025/0129575 A1 Apr. 24, 2025

(30) Foreign Application Priority Data

Nov. 10, 2021 (JP) ..... 2021-183509

(51) Int. Cl.
*E02F 9/24* (2006.01)
*E02F 9/20* (2006.01)

(52) U.S. Cl.
CPC ..... *E02F 9/24* (2013.01); *E02F 9/2004* (2013.01); *E02F 9/2062* (2013.01)

(58) Field of Classification Search
CPC ..... E02F 9/24; E02F 9/2004; E02F 9/2062
(Continued)

(56) References Cited

U.S. PATENT DOCUMENTS

2012/0205171 A1 8/2012 Takishita et al.
2019/0352883 A1* 11/2019 Nishiguchi ..... E02F 9/0883
(Continued)

FOREIGN PATENT DOCUMENTS

CN 101922489 A 12/2010
JP 2005248468 A * 9/2005 ..... E02F 9/22
(Continued)

OTHER PUBLICATIONS

Machine translation for JP-2005248468-A (Year: 2005).*
(Continued)

*Primary Examiner* — Kenneth M Dunne
*Assistant Examiner* — Brian K Palmarchuk
(74) *Attorney, Agent, or Firm* — Oblon, McClelland, Maier & Neustadt, L.L.P.

(57) ABSTRACT

A work machine is capable of inhibiting an unintended machine motion and reducing energy consumption. The work machine includes a controller, a drive source, a controller switch to which an on-operation and an off-operation are applied, a lock operation member to which a lock operation and a lock release operation for invalidating and validating a lever operation, respectively, are applied, and a drive source switch to which a start operation and a stop operation for starting and stopping the drive source, respectively, are applied. After activated by the on-operation applied to the controller switch, the controller starts the drive source when judging that the lock-release operation is applied to the lock operation member and the start operation is applied to the drive source switch, whereas suspends starting the drive source when judging that both the lock-release operation and the start operation has not been applied.

2 Claims, 7 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2022/0042285 | A1* | 2/2022 | Katayama | E02F 9/2285 |
| 2022/0154427 | A1* | 5/2022 | Misaki | E02F 9/2267 |
| 2024/0060270 | A1* | 2/2024 | Kaneda | E02F 9/2228 |

FOREIGN PATENT DOCUMENTS

| | | | | |
|---|---|---|---|---|
| JP | 2011-256608 | A | 12/2011 | |
| JP | 2012-21394 | A | 2/2012 | |
| JP | 2013-36270 | A | 2/2013 | |
| JP | 5819265 | B2 * | 11/2015 | E02F 9/20 |
| JP | 2017-203253 | A | 11/2017 | |
| JP | 2020-100940 | A | 7/2020 | |
| JP | 2020-143453 | A | 9/2020 | |
| KR | 10-2018-0034883 | A | 4/2018 | |
| WO | WO 2021/020405 | A1 | 2/2021 | |

OTHER PUBLICATIONS

Machine translation for JP-5819265-B2 (Year: 2015).*
Extended European Search Report issued Dec. 16, 2024 in European Patent Application No. 22892492.4, 9 pgs.
International Search Report Issued Nov. 15, 2022, in PCT/JP2022/0383983, filed on Oct. 14, 2022, 2 pages.
Office Action issued May 28, 2026 in Chinese Patent Application No. 202280073561.7, with English translation.

* cited by examiner

WORK MACHINE FOR CONTROLLING STARTING AND STOPPING OF DRIVE SOURCE

TECHNICAL FIELD

The present invention relates to a work machine including a drive source and a controller that controls starting and stopping of the drive source.

BACKGROUND ART

Conventionally have been proposed a work machine with a function of inhibiting a motion unintended by an operation.

For example, Patent Literature 1 discloses a hydraulic work machine capable of locking the action of an actuator. In the hydraulic work machine, the engine is started by the operation of a start switch. The lock lever is thereafter rotationally moved to a lock release position, whereby a lock valve is brought into an ON state to allow a pilot pressure to be supplied to a selector valve. The selector valve stays in an OFF state when a shut-off switch is not operated, thereby keeping the actuator stopped.

When the shut-off switch is operated during the above state to bring the selector valve into ON state, the pilot pressure is supplied to the pilot valve located downstream of the selector valve. When an operation lever is not operated, however, the pilot valve is fully closed to keep the actuator stopped.

When an operator operates the operation lever in this state, the pilot valve is opened to allow a pilot pressure to be supplied to the actuator. The actuator is thereby operated.

On the other hand, Patent Literature 2 discloses a construction machine capable of reducing the consumption of battery power.

In the construction machine, a power source of an inverter device or the like is brought into an ON state when a key switch is operated from an Off-position to a START position.

Meanwhile, a main control unit and a fan control unit judge whether a lock lever is at a lock position or a lock release position, on the basis of the presence/absence of the input of a signal from a lock switch. When judging that the lock lever is at the lock release position, the fan control unit makes an electric fan motor driven to rotate a cooling fan.

During the start period of the hydraulic excavator or during operator's operation of any one of operation devices, a main electric motor is driven.

According to the hydraulic excavator described in Patent Literature 1, where the engine is immediately started after the operation of the start switch, the engine is idling-operated until the manual operation of the shut-off switch after the start of the engine and further the operation of the operation lever, thereby unnecessarily consuming energy.

On the other hand, according to the hydraulic excavator described in Patent Literature 2, there is a possibility that a machine motion not intended by an operator is caused by unconscious contact of the operator with the operation lever being at the lock release position.

CITATION LIST

Patent Literature

Patent Literature 1: Japanese Unexamined Patent Publication No. 2013-36270

Patent Literature 2: Japanese Unexamined Patent Publication No. 2011-256608

SUMMARY OF INVENTION

It is an object of the present invention to provide a work machine capable of inhibiting a machine motion not intended by an operator and reducing energy consumption.

Provided is a work machine including a drive source, a controller, a controller switch, an operation lever, a lock operation member, and a drive source switch. The controller controls start and stop of the drive source. The controller switch allows an on-operation for activating the controller and an off-operation for stopping the controller to be applied to the controller switch. The operation lever allows a lever operation for moving an operation target to be applied to the operation lever. The lock operation member allows a lock operation for invalidating the lever operation and a lock release operation for validating the lever operation to be applied to the lock operation member. The drive source switch allows a start operation for starting the drive source and a stop operation for stopping the drive source to be applied to the drive source switch. The controller is configured to start the drive source when judging that the lock release operation is applied to the lock operation member and the start operation is applied to the drive source switch in a state where the on-operation is applied to the controller switch and the controller has been activated, and configured to suspend the start of the drive source when the lock release operation is not applied to the lock operation member or when the start operation is not applied to the drive source switch in a state where the on-operation is applied to the controller switch and the controller has been activated.

DETAILED DESCRIPTION

A preferred embodiment of the present invention will be described with reference to FIGS. 1 to 6.

Figure 1:
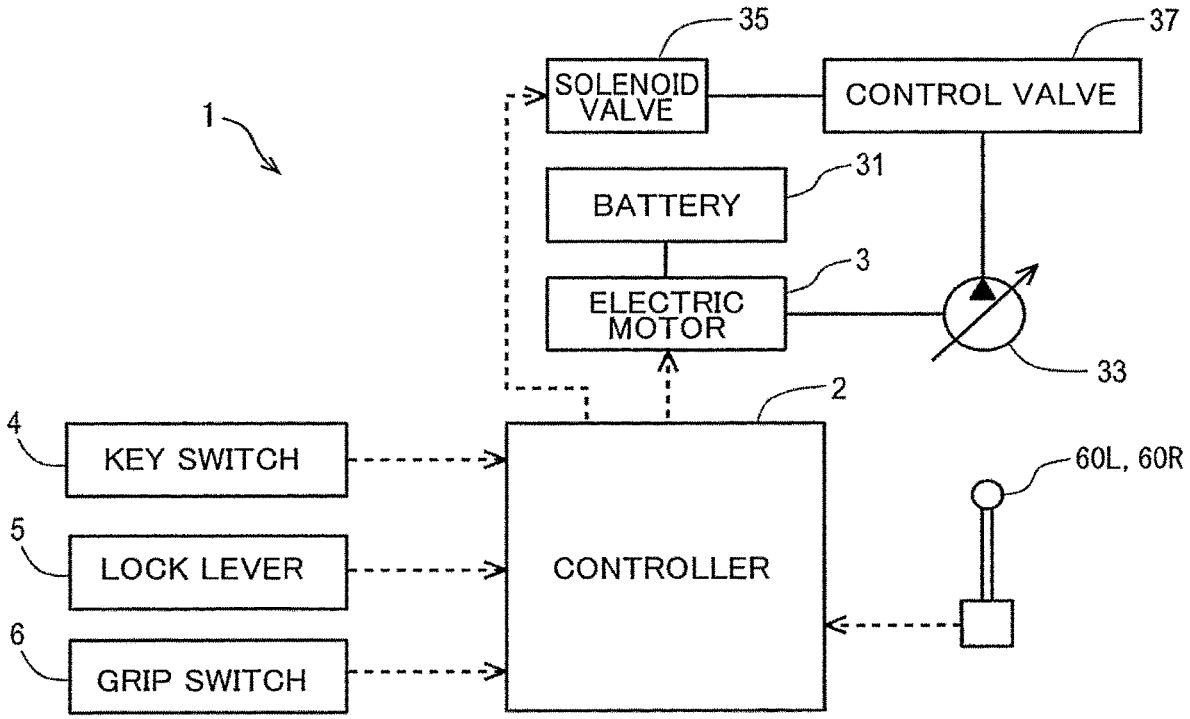
FIG. 1 shows a control system of an electric-power hydraulic excavator according to an embodiment of the present invention.

FIG. 1 shows a control system installed on an electric-power hydraulic excavator 1, which is a work machine according to the embodiment. The electric-power hydraulic excavator 1 includes a controller 2, an electric motor 3, a key switch 4, a lock lever 5, a grip switch 6, a left operation lever 60L, a right operation lever 60R, a battery 31, a hydraulic pump 33, a non-illustrated plurality of hydraulic actuators, a plurality of control valves 37, and a plurality of solenoid valves 35.

The controller 2 performs a control of the motion of the electric-power hydraulic excavator 1, the control including the control of the start and stop of the electric motor 3.

The electric motor 3 is a drive source of the electric-power hydraulic excavator 1. The electric motor 3 is driven by electric power supplied from the battery 31 to thereby drive the hydraulic pump 33 and a non-illustrated pilot pump. The hydraulic pump 33 is a variable-displacement hydraulic pump, which is driven by the electric motor 3 to discharge hydraulic fluid. The hydraulic pump 33 includes a pump body having a variable pump capacity and a regulator for changing the pump capacity. The regulator changes the pump capacity in accordance with a pump capacity command that is input from the controller 2.

Figure 2:
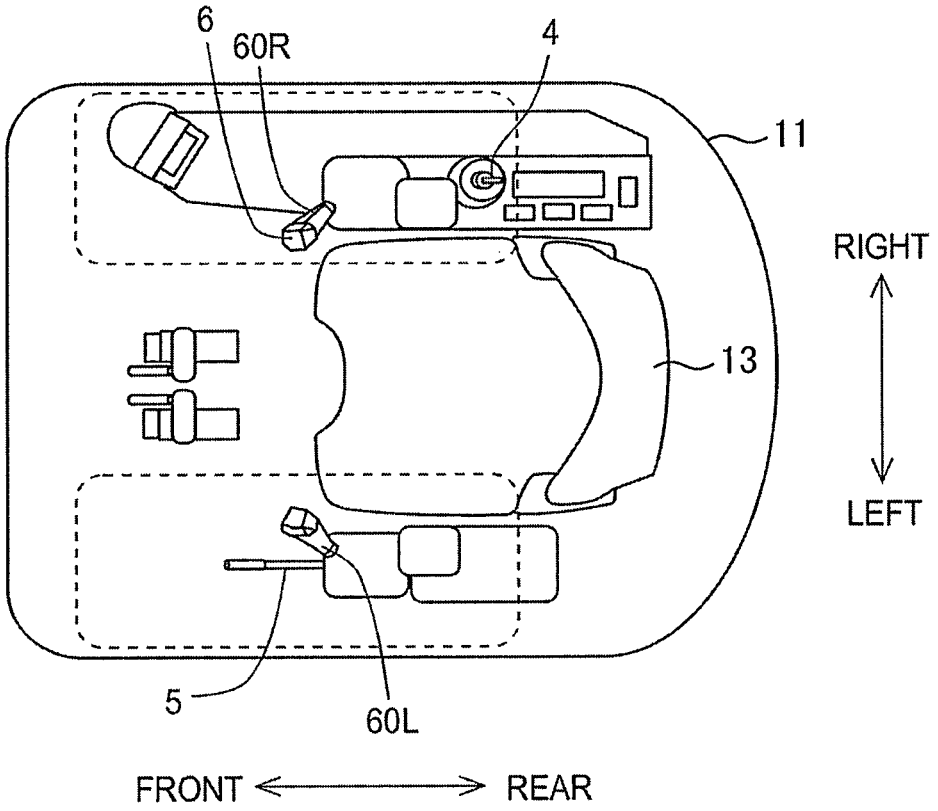
FIG. 2 is a plan view showing the inside of a cab of the electric-power hydraulic excavator.
Figure 3:
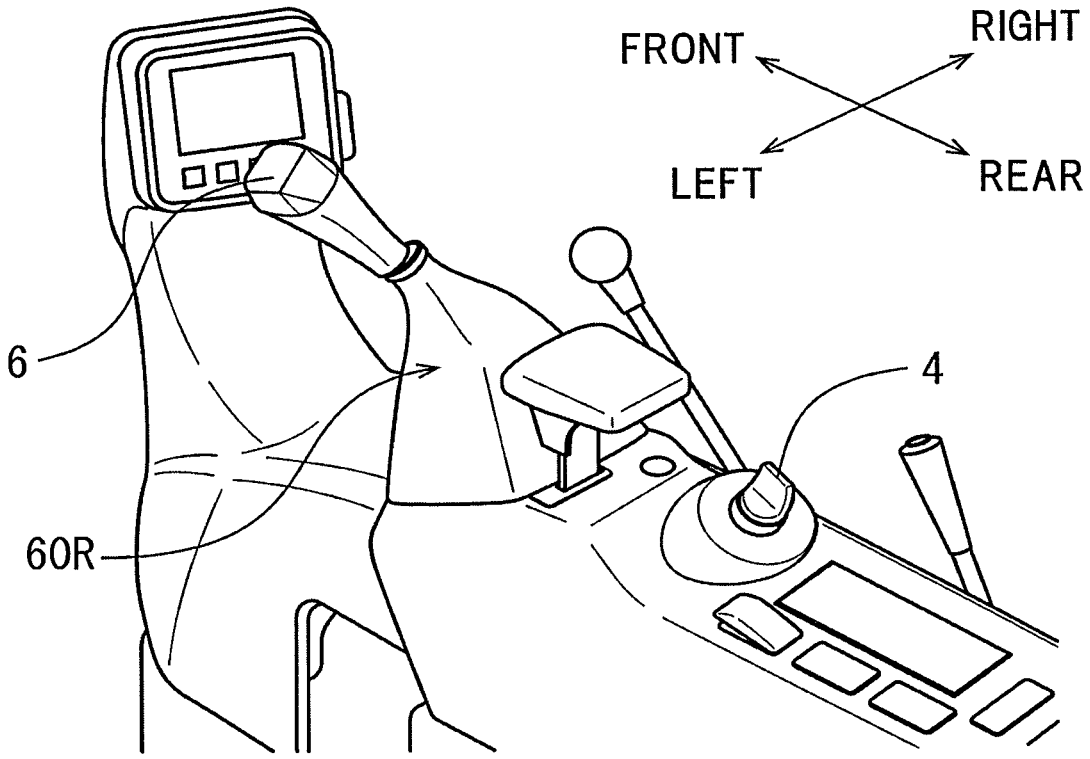
FIG. 3 is a perspective view showing the right front part of the cab.
Figure 4:
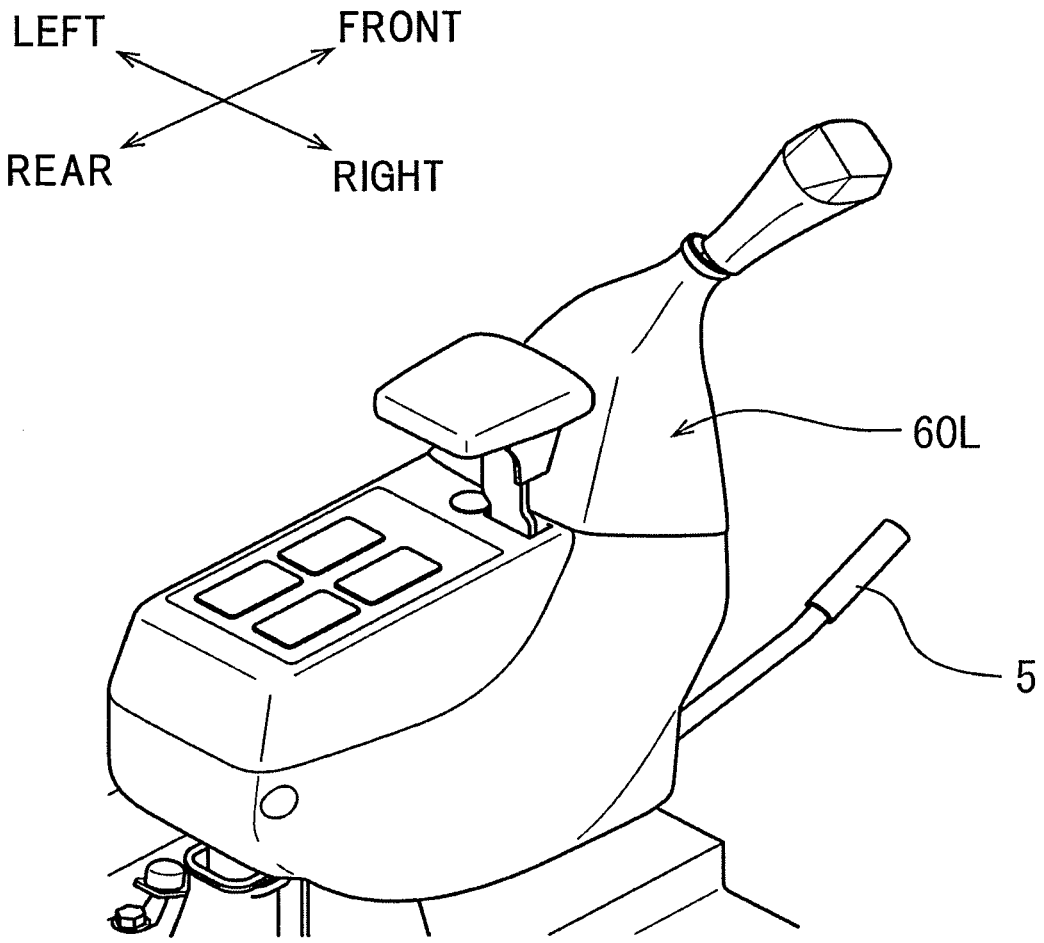
FIG. 4 is a perspective view showing the left front part of the cab.

The electric-power hydraulic excavator 1 further includes a cab 11 shown in FIG. 2, in which an operation seat 13 is disposed. As shown in FIGS. 2 to 4, the left and right operation levers 60L and 60R are disposed on respective front sides of consoles disposed on both left and right sides of the operation seat 13, respectively. Each of the operation levers 60L and 60R constitutes an electric lever device in association with a non-illustrated lever sensor. The lever sensor converts a manipulated variable, which is the magnitude of the operation input to each of the operation levers 60L and 60R (the tilt angle of the operation levers 60L, 60R), into an operation signal, which is an electrical signal, and inputs it to the controller 2.

The plurality of hydraulic actuators make respective actions to actuate a plurality of movable parts included in the electric-power hydraulic excavator 1, respectively. The plurality of hydraulic actuators are operated by hydraulic fluid supplied from the hydraulic pump 33 through the plurality of control valves 37, respectively. The plurality of hydraulic actuators are operation targets that are moved by the lever operation applied to the right and left operation levers 60L, 60R.

The plurality of control valves 37 are interposed between the hydraulic pump 33 and the plurality of hydraulic actuators, respectively, to allow respective actions of the plurality of hydraulic actuators to be controlled by the controller 2. Each of the control valves 37 is composed of a pilot-operated hydraulic selector valve and configured to be opened so as to allow hydraulic fluid to be supplied from the hydraulic pump 33 to a hydraulic actuator corresponding to the control valve 37 among the plurality of hydraulic actuators at a flow rate corresponding to the pilot pressure that is input to the control valve 37.

The plurality of solenoid valves 35 are interposed between the non-illustrated pilot pump and the plurality of control valves 37 and make respective opening actions so as to change the pilot pressures to be input from the pilot pump to the control valves 37, respectively. In other words, each of the solenoid valves 35 regulates the pilot primary pressure, which is the discharge pressure of the pilot pump, at a degree corresponding to a drive signal input from the controller 2 to generate a pilot pressure corresponding to the command signal (pilot secondary pressure), and inputs the pilot pressure to the control valve 37 to which the solenoid valve 35 is connected among the plurality of control valves 37. Based on the operation signal input from the electric lever device, the controller 2 generates, as the drive signal, such a signal as to make the plurality of hydraulic actuators make respective actions corresponding to the lever operation, respectively, and inputs the signal to the corresponding solenoid valve 35.

As shown in FIGS. 2 and 3, the key switch 4 is a physical key that can be rotationally operated, located behind the right operation lever 60R on the right side of the operation seat 13 in the example shown in FIGS. 2 and 3. The key switch 4 is switched from an off-position to an on-position or from the on-position to the off-position, by the rotational operation that is applied by an operator.

The key switch 4 is a controller switch to be operated so as to turn on and off the controller 2. Specifically, the key switch 4 is configured to be made allow an activation command signal to be input to the controller 2 by an operation of rotating the key switch 4 from the off-position to the on-position (namely, on-operation), the activation command signal activating (energizing) a plurality of electrical components including the controller 2. The key switch 4 is configured, conversely, to be made allow a stop command signal to be input to the controller 2 by an operation of rotating the key switch 4 from the on-position to the off-position (namely, off-operation), the stop command signal stopping the electrical component including the controller 2 (halting the energization).

The key switch 4, thus, serves as a switch that allows the on-operation for activating (energizing) the electric component including the controller 2 and the off-operation for stopping (halting the energization of) the electric component to be input to the key switch 4, namely, the controller switch. The "controller switch" according to the present invention, alternatively, may be a push-type switch to which a pressing operation is applied as each of the on-operation and the off-operation.

The lock lever 5 is a safety lever for preventing the actuator from being activated against the operator's intention in a non-operation state.

In the arrangement illustrated in FIGS. 2 and 4, the lock lever 5 is provided on the front side of the left operation lever 60L and on the left side of the operation seat 13. The lock lever 5 is a lock operation member capable of being moved between a lock position on the upper side and a lock release position on the lower side by an operator's manual operation. Specifically, the manual operation includes a pull-up operation of pulling up the lock lever 5 to move it to the lock position and a push-down operation of pushing down the lock lever 5 to move it to the lock release position.

The lock lever 5 is configured to allow a lock command signal to be input to the controller 2 when the lock lever 5 is moved from the lock release position to the lock position by the pulling operation. The controller 2 stops the input of the drive signal to the solenoid valve 35 in accordance with the input of the lock command signal, thereby making the solenoid valve 35 closed to make the input of the pilot pressure to the control valve 37 forcibly stopped. The controller 2, alternatively, may be configured to block the supply of pilot primary pressure from the pilot pump to the solenoid valve 35 in accordance with the input of the lock command signal. In either case, the lever operation applied to each of the operation levers 60L and 60R is invalidated. Specifically, regardless of each of the lever operation applied to the operation levers 60L and 60R, the input of the drive signal from the controller 2 to the solenoid valve 35 is forcibly stopped.

Conversely, the lock lever 5 is configured to stop the input of the lock command signal to the controller 2 to allow the drive signal to be input from the controller 2 to the solenoid valve 35 when the lock lever 5 is moved from the lock position to the lock release position by the push-down operation. By the input of the drive signal, the solenoid valve 35 is opened to allow the pilot pressure to be supplied to the control valve 37. The lever operation applied to each of the operation levers 60L and 60R is, thus, validated, and the drive signal is allowed to be input from the controller 2 to the control valve 37 corresponding to the lever operation.

The lock lever 5, thus, allows a lock operation for invalidating the lever operation to be applied to the operation levers 60L, 60R and a lock release operation for validating the lever operation to be input to the lock lever 5. The lock lever 5, thus, serves as a lock operation member.

The grip switch 6 is a switch for switching the start or stop of the electric motor 3 as a drive source, namely, a drive source switch. In the arrangement illustrated in FIGS. 2 and 3, the grip switch 6 is provided to the upper end of the right operation lever 60R to allow a pressing operation to be applied to the grip switch 6 by an operator. The grip switch 6 is, thus, composed of a push type switch in the present embodiment. In the present embodiment, each time the pressing operation is applied to the grip switch 6, the start and stop of the electric motor 3 are alternately switched. Specifically, the press operation applied to the grip switch 6 during the stop of the electric motor 3 corresponds to the start operation for starting the electric motor 3, and the grip switch 6 to which the start operation has been applied allows a start command signal to be input to the controller 2. The controller 2 starts the electric motor 3 in accordance with the input of the start command signal. The pressing operation applied to the grip switch 6 during driving of the electric motor 3, conversely, corresponds to a stop operation for stopping the electric motor 3, and the grip switch 6 to which the stop operation has been applied allows a stop command signal to be input to the controller 2. The controller 2 forcibly stops the electric motor 3 in accordance with the input of the stop command signal. The grip switch 6, thus, serves as the drive source switch according to the present invention.

Subsequently is described the control actions performed by the controller 2 with reference to the flowchart shown in FIGS. 5 and 6.

Figure 5:
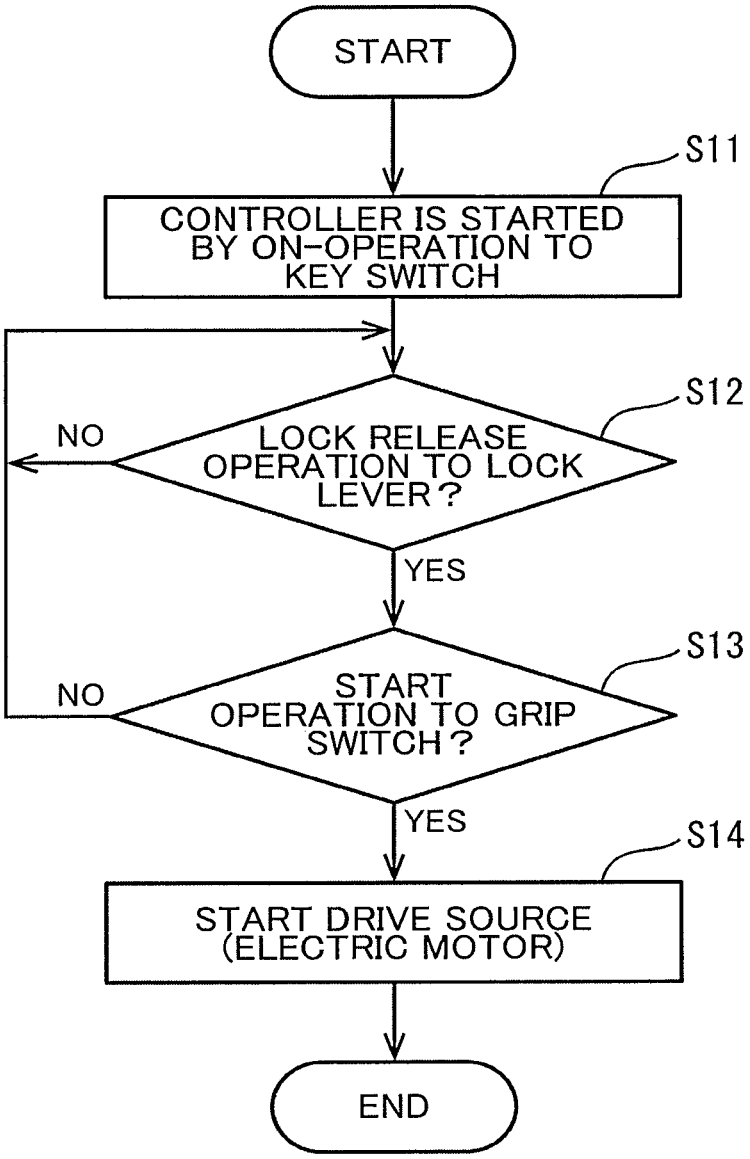
FIG. 5 is a flowchart showing a control action performed by a controller of the electric-power hydraulic excavator for starting an electric motor.

FIG. 5 shows the actions performed for starting the electric motor 3 as the drive source.

Initially, an operator operates the key switch 4 to switch the key switch 4 from the off-position to the on-position, whereby an activation command signal is input to the controller 2 to make electrical components including the controller 2 activated, that is, energized (step S11).

The thus activated controller 2 judges whether or not the lock lever 5 is at the lock release position. In other words, the controller 2 judges whether or not the lock release operation for validating the lever operation applied to each of the operation levers 60L and 60R is applied to the lock lever 5 (step S12).

When judging that the lock release operation has been applied to the lock lever 5 (YES in step S12), the controller 2 performs the process of step S13. Specifically, the controller 2 judges whether or not the start operation is applied to the grip switch 6, that is, whether or not the pressing operation has been applied to the grip switch 6 with the electric motor 3 stopped.

When judging that the start operation has been applied to the grip switch 6 (YES in step S13), the controller 2 starts the electric motor 3 that is the driving source (step S14). The hydraulic pump 33 is thereby driven to discharge hydraulic fluid at the lowest flow rate from the hydraulic pump 33 while the regulator of the hydraulic pump 33 minimizes the tilt angle of the hydraulic pump 33, that is, with the minimum pump capacity of the hydraulic pump 33. Meanwhile, the pilot pump is also driven to supply a pilot primary pressure to each of the solenoid valves 35. In this state, when a lever operation is applied to the left operation lever 60L or the right operation lever 60R to displace the left operation lever 60L or the right operation lever 60R from a neutral position in the direction of the lever operation, the controller 2 inputs a drive signal to the solenoid valve 35 that corresponds to the lever operation among the plurality of solenoid valves 35 to open the solenoid valve 35, allowing a pilot pressure (pilot secondary pressure) to be supplied from the solenoid valve 35 to the control valve 37 that is connected to the solenoid valve 35. The control valve 37 thereby allows the hydraulic actuator (operation target) corresponding to the control valve 37 to be supplied with hydraulic fluid from the hydraulic pump 33 at a flow rate corresponding to the pilot pressure. Furthermore, in the present embodiment, the controller 2 inputs such a pump capacity command as to increase the pump capacity of the hydraulic pump 33 to the hydraulic pump 33 with an increase in the lever operation applied to the left operation lever 60L or the right operation lever 60R, that is, with an increase in the displacement of the left operation lever 60L or the right operation lever 60R from the neutral position, thereby allowing the hydraulic actuator to be driven more suitably.

Figure 6:
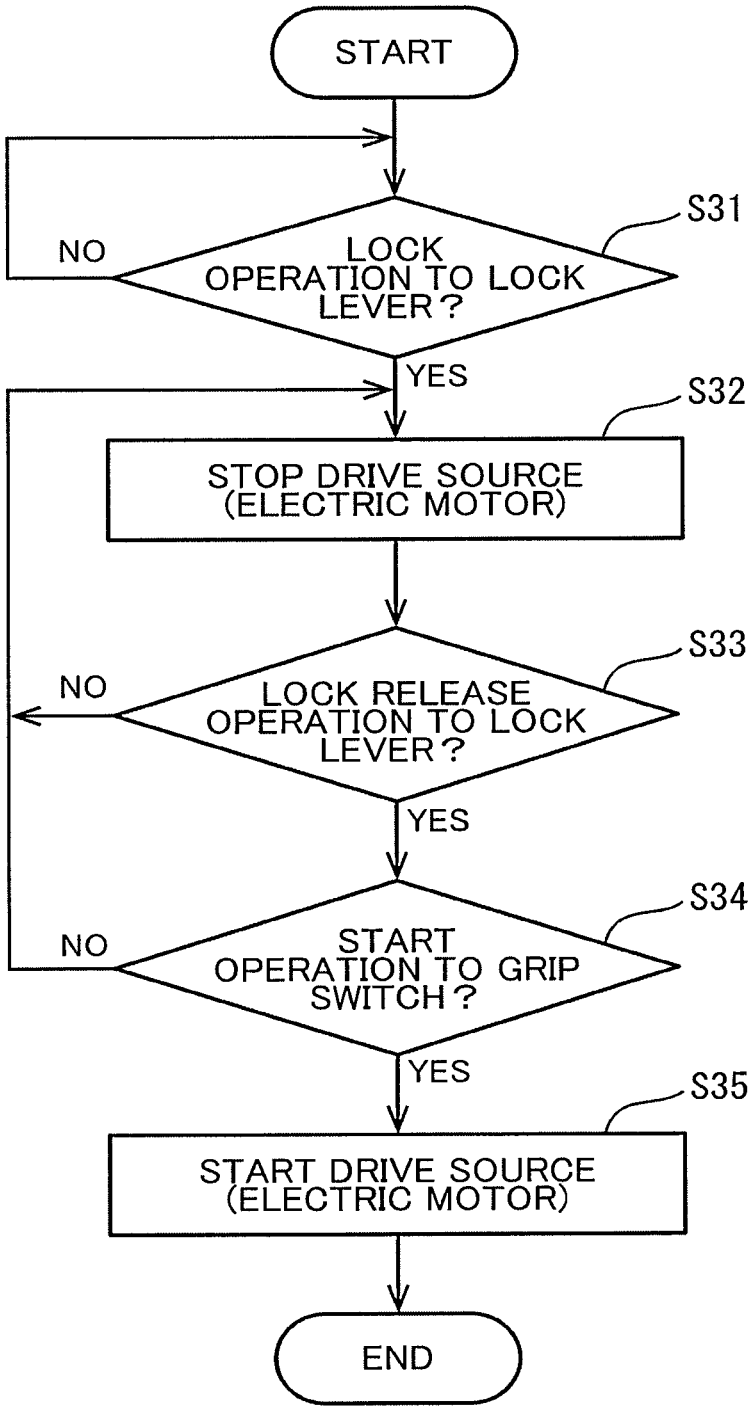
FIG. 6 is a flowchart showing a control action by the controller for restarting the electric motor that has been stopped.

FIG. 6 shows the actions for restarting the electric motor 3 that has been stopped in accordance with the lock operation applied to the lock lever 5.

Initially, in step S31, the controller 2 judges whether or not the lock lever 5 has been moved from the lock release position to the lock position during the driving of the electric motor 3. In other words, the controller 2 judges whether or not the lock operation for invalidating the lever operation applied to each of the left and right operation levers 60L and 60R has been applied to the lock lever 5.

When judging that the lock operation has been applied to the lock lever 5 (YES in step S31), the controller 2 forcibly stops the electric motor 3 as the driving source (step S32).

After thus forcibly stopping the electric motor 3, the controller 2 judges whether or not the lock lever 5 has been returned from the lock position to the lock release position, in other words, whether or not the above-described lock release operation has been re-applied to the lock lever 5 (step S33). Until judging that the lock release operation has been applied to the lock lever 5 (NO in step S33), the controller 2 keeps the forcible stop of the electric motor 3.

At the time when judging that the lock release operation is applied to the lock lever 5 (YES in step S33), the controller 2 judges whether or not the push-down operation has been applied to the grip switch 6, that is, whether or not the start operation is applied to the grip switch 6, with the electric motor 3 stopped as described above (step S34). At the time when judging that the start operation has been applied to the grip switch 6 (YES in step S34), the controller 2 restarts the electric motor 3 as the driving source.

Although not shown in the flowchart of FIG. 6, the controller 2 forcibly stops the electric motor 3 also both when the off-operation has been applied to the key switch 4 during the driving of the electric motor 3 and when judging that the pressing operation or the stopping operation has been applied to the grip switch 6. In summary, when judging that at least one of the application of the off-operation to the key switch 4 and the application of the stop operation to the grip switch 6 has been performed during the driving of the electric motor 3, the controller 2 stops the electric motor 3 which is the drive source.

The controller 2, thus, suspends the start of the electric motor 3, which is the driving source, unless the start operation is applied to the grip switch 6, even if the lock release operation is applied to the lock lever 5 with the electric motor 3 stopped. This prevents a machine motion not intended by an operator from being caused by unconscious contact of the operator with the control lever (either of the left and right operation levers 60L, 60R in the present embodiment) while the lock release operation is being performed.

Furthermore, the controller 2 according to the present embodiment suspends the start of the electric motor 3, which is the driving source, unless all of the on-operation applied to the key switch 4, the lock release operation applied to the lock lever 5, and the start operation applied to the grip switch 6 are recognized, thereby allowing energy consumption by the electric motor 3 to be reduced.

Besides, the controller 2 according to the embodiment is configured to stop the electric motor 3, which is the drive source, when judging that any of the application of the off-operation to the key switch 4, the application of the lock operation to the lock lever 5, and the application of the stop operation to the grip switch 6 has been performed during the driving of the electric motor 3. This enables an operator to quickly stop the electric motor 3 at the time of resting work or the like. This also reduces energy consumption by the electric motor 3 to be reduced.

The controller 2 according to the embodiment suspends the restart of the electric motor 3 unless the start operation is applied to the grip switch 6, even if the lock release operation is applied to the lock lever 5, while the electric motor 3 is stopped in accordance with the lock operation applied to the lock lever 5. This prevents the machine from performing a motion not intended by the operator immediately upon the application of the lock release operation to the lock lever 5, thereby allowing high safety to be secured.

The work machine according to the present invention is not limited to the embodiment having been described but allowed to be various modified and improved in the scope of the claims.

Figure 7:
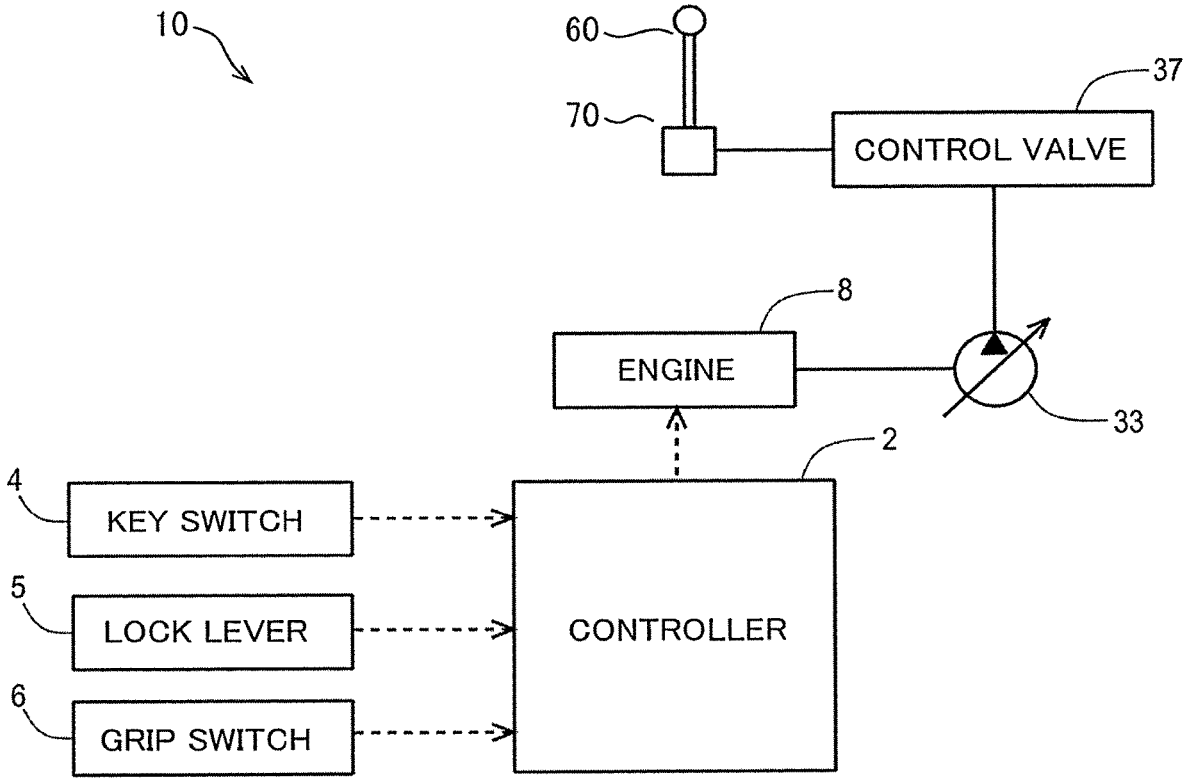
FIG. 7 is a view showing a control system of a hydraulic excavator according to a modification.

Although the electric-power hydraulic excavator shown in FIG. 1 includes the electric motor 3 as a drive source, the present invention can be applied, for example, as shown in FIG. 7, to also a hydraulic excavator 10 provided with an engine 8 as a drive source. The hydraulic excavator 10 includes, in addition to an operation lever 60, a remote-control valve 70 coupled with the operation lever 60. The remote-control valve 70 is interposed between a non-illustrated pilot pump and a control valve 37 and configured to be opened in conjunction with a lever operation that is applied to the operation lever 60 so as to allow a pilot pressure corresponding to the magnitude of the lever operation applied to the operation lever 60, namely, an operation amount, to be input to the control valve 37. When an operator applies a lock operation to the lock lever 5 (for example, pulls up the lock lever 5 to move it from a lock release position to a lock position), the controller 2 forcibly blocks the supply of pilot primary pressure to the remote-control valve 70 by, for example, making a non-illustrated lock valve disposed upstream of the remote-control valve 70 closed, thereby disabling pilot pressure from being supplied to the control valve 37 to invalidate the lever operation applied to the operation lever 60. When an operator applies a lock release operation to the lock lever 5 (for example, push down the lock lever 5 to move it from the lock position to the lock release position), conversely, the controller 2 allows the pilot primary pressure to be supplied to the remote-control valve 70 by, for example, making the lock valve opened, thereby allowing the pilot pressure to be supplied to the control valve 37 to validate the lever operation on the operation levers 60L, 60R. The control performed by the controller 2 for starting the engine 8 is similar to the control for starting the electric motor 3 according to the embodiment, that is, the control shown in the flowchart of FIG. 5. Specifically, in step S14 of FIG. 5, the controller 2 according to the present modification starts the engine 8, which is a driving source in place of the electric motor 3.

As has been described, there is provided a work machine capable of inhibiting a machine motion not intended by an operator and reducing energy consumption. The work machine includes a drive source, a controller, a controller switch, an operation lever, a lock operation member, and a drive source switch. The controller controls start and stop of the drive source. The controller switch allows an on-operation for activating the controller and an off-operation for stopping the controller to be applied to the controller switch. The operation lever allows a lever operation for moving an operation target to be applied to the operation lever. The lock operation member allows a lock operation for invalidating the lever operation and a lock release operation for validating the lever operation to be applied to the lock operation member. The drive source switch allows a start operation for starting the drive source and a stop operation for stopping the drive source to be applied to the drive source switch. The controller is configured to start the drive source when judging that the lock release operation is applied to the lock operation member and the start operation is applied to the drive source switch in a state where the on-operation is applied to the controller switch and the controller has been activated, and configured to suspend the start of the drive source, when the lock release operation is not applied to the lock operation member or when the start operation is not applied to the drive source switch, in a state where the on-operation is applied to the controller switch and the controller has been activated.

The controller suspends the start of the drive source when the start operation is not applied to the drive source switch, even if the lock release operation is applied to the lock operation member. This prevents a machine motion not intended by the operator from being caused by unconscious contact of an operator, who is performing the lock release operation, with the operation lever. Besides, the drive source cannot be started except for the case where all of the application of the on-operation to the controller switch, the application of the lock release operation to the lock operation member, and the application of the start operation to the drive source switch are performed, which allows energy consumption to be reduced.

During the driving of the drive source, preferably, the controller is configured to stop the drive source when judging that any of the application of the off-operation to the controller switch, the application of the lock operation to the lock operation member, and the application of the stop operation to the drive source switch has been performed. This enables an operator to quickly stop the drive source upon resting work or the like. This also allows energy consumption by the drive source to be reduced.

Preferably, the controller is configured to suspend the start of the drive source, after judging that the lock operation is applied to the lock operation member to stop the drive source, until judging that the start operation is applied to the drive source switch, even if judging that the lock release operation is applied to the lock operation member, and configured to start the drive source, after judging that the lock operation is applied to the lock operation member to stop the drive source, when judging that the lock release operation is applied to the lock operation member and the start operation is applied to the drive source switch. This prevents the machine from performing a motion unintended by an operator immediately upon the application of the lock release operation to the lock operation member, thereby allowing high safety to be secured.

The invention claimed is:

1. A work machine comprising:

a drive source;

a controller that controls start and stop of the drive source;

a controller switch that is switched from an off-position to an on-position or from the on-position to the off-position, and allows an on-operation for activating the controller and an off-operation for stopping the controller to be applied to the controller switch;

an operation lever that allows a lever operation for moving an operation target to be applied to the operation lever;

a lock operation member that allows a lock operation for invalidating the lever operation and a lock release operation for validating the lever operation to be applied to the lock operation member; and a drive source switch that is provided separately from the controller switch and is a switch for switching the start or stop of the drive source and allows a start operation for starting the drive source and a stop operation for stopping the drive source to be applied to the drive source switch, wherein the controller is configured to start the drive source only when all of the following conditions (i) to (iii) are satisfied, and to suspend the start of the drive source when at least one of the conditions (i) to (iii) fails to be satisfied:

(i) the on-operation is applied to the controller switch and the controller has been activated;

(ii) the lock release operation is applied to the lock operation member; and (iii) the start operation is applied to the drive source switch, and the controller is configured to stop the drive source, during the driving of the drive source, when judging that an application of the off-operation to the controller switch has been performed, the controller is configured to stop the drive source, during the driving of the drive source, when judging that an application of the lock operation to the lock operation member has been performed, and the controller is configured to stop the drive source, during the driving of the drive source, when judging that an application of the stop operation to the drive source switch has been performed.

2. The work machine according to claim 1, wherein, after judging that the lock operation is applied to the lock operation member to stop the drive source, the controller is configured to start the drive source only when all of the following conditions (iv) and (v) are satisfied, and to suspend the start of the drive source when at least one of the conditions (iv) and (v) fails to be satisfied:

(iv) the lock release operation is applied to the lock operation member; and (v) the start operation is applied to the drive source switch.

* * * * *